US005993090A

United States Patent [19]

Straka et al.

[11] Patent Number: 5,993,090

[45] **Date of Patent: *Nov. 30, 1999**

[54] MARKING PUNCH

[75] Inventors: Gordon A. Straka, Afton; Stephen R. Simmons, Marine, both of Minn.

[73] Assignee: Wilson Tool International, Inc., White Bear Lake, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/058,005

[22] Filed: Apr. 9, 1998

[51] Int. Cl.[6] ..... B41J 1/54

[52] U.S. Cl. ..... 400/134.4; 400/134; 101/29; 30/364; 83/552

[58] Field of Search ..... 101/28, 29, 18; 400/134, 134.1, 134.2, 134.3, 142, 134.4; 81/438, 177.85; 83/552; 30/364; 234/110, 113

[56] References Cited

U.S. PATENT DOCUMENTS

| | | | |
|---|---|---|---|
| 2,115,456 | 4/1938 | Chisholm | 400/142 |
| 2,260,370 | 10/1941 | Ferguson | 83/588 |
| 2,278,184 | 3/1942 | Olson | 83/169 |
| 3,042,175 | 7/1962 | Güttel | 400/134 |
| 4,041,817 | 8/1977 | Nelson | 83/139 |
| 4,137,962 | 2/1979 | Pol | 101/18 |
| 4,339,209 | 7/1982 | Tanigami | 400/142 |
| 4,569,267 | 2/1986 | Klingel | 400/134 |
| 5,070,781 | 12/1991 | Lundstrom et al. | 101/32 |
| 5,072,620 | 12/1991 | Hill et al. | 400/134 |
| 5,201,589 | 4/1993 | Chun et al. | 400/134 |
| 5,382,102 | 1/1995 | Brolund et al. | 400/134 |
| 5,438,897 | 8/1995 | Chun | 83/146 |
| 5,495,671 | 3/1996 | Shun-Yi | 30/364 |
| 5,697,278 | 12/1997 | Shun-Yi | 83/588 |
| 5,848,563 | 12/1998 | Saito | 83/552 |

*Primary Examiner*—Edgar Burr
*Assistant Examiner*—Leslie J. Grohusky
*Attorney, Agent, or Firm*—Fredrickson & Byron, PA

[57] ABSTRACT

The invention provides a tool which can be used with a punch press. On such tool includes a marking punch which has a recess; a marking punch magazine having a channel in which the marking punch is received and an external surface having a transverse groove therein which is in communication with the channel; a striker which strikes the marking punch to move the marking punch from its rest position to its marking position; and a resiliently compressible body received in the transverse groove of the magazine and in the recess in the marking punch. This compressible body desirably is compressed between the magazine and the marking punch when the marking punch is in its marking position, but resiliently biases the marking punch towards its rest position. The invention also provides a method of marking a workpiece, which method can employ such a tool.

6 Claims, 2 Drawing Sheets

MARKING PUNCH

FIELD OF THE INVENTION

The present invention generally relates to marking punches of the type used to mark sheet material and articles of manufacture, and more particularly provides a multi-tool marking punch device useful in conjunction with a punch press.

BACKGROUND OF THE INVENTION

Punch tools have long been used for the machining of various metal workpieces. Punches commonly are held in turrets configured so that rotation of the turret positions selected punches under a ram-driven striker. A punch tool assembly may itself have several punch tools circumferentially arranged with the punch assembly supported in a rotatable punch magazine so that desired individual punches can be rotated into position under a striker.

Of particular interest are punch assemblies used to mark workpieces with desired alpha-numeric indicia or other symbols. These marking punches, also known as letterstamps, are designed to mark a workpiece with a given character or string of characters. Selected characters can be represented by different marking punches housed within a punch magazine. In use, the magazine is rotated to place the selected marking punch in position to be contacted by the striker during the punch stroke.

During the punch stroke the ram momentarily forces the marking punch from a rest position to a marking position against the workpiece. After the marking punch marks the workpiece, it returns, under the influence of a biasing mechanism to its rest position.

The need for a reliable biasing mechanism to return the marking punch to its resting position within the magazine has made the manufacture, assembly, and maintenance of such multi-tool marking punch devices mechanically complex. It would be advantageous to provide a simple and flexible biasing mechanism structure enabling ready assembly of such a multi-tool punch magazine for use in press punch devices, particularly for use in multi-tool marking punch press devices.

SUMMARY OF THE INVENTION

The present invention contemplates a marking tool for use with a punch press, a method of using the tool, and a method of assembling the tool.

One embodiment of a tool of the invention includes an axially movable marking punch having a recess transverse to its axis; a marking punch magazine having a channel in which the marking punch is movably received and having a surface with a transverse groove therein which is aligned with the recess when the marking punch is in a rest position; a striker positioned to strike the marking punch to force the marking punch from its rest position to a marking position; and a resiliently compressible body received in the transverse groove of the magazine and in the recess of the marking punch. This compressible body is configured to be compressed between the magazine and the marking punch when the marking punch is in its marking position, but resiliently biases the marking punch towards its rest position. The tool may also include a punch holder which carries the magazine such that it is rotatable with respect to the striker to position a selected punch into position to be struck by the striker.

In a preferred embodiment, the punch magazine has a plurality of marking punches and a plurality of parallel, circumferentially spaced channels each sized to slidably receive a respective marking punch and to enable each marking punch to move therein between rest and marking positions. A striker is adapted to selectively strike a selected one of the punches to move the selected punch from its rest position to its punching position during a punching operation. Each marking punch is provided with a transverse recess in communication with its channel, and the punch magazine is provided with an annular groove aligned with the transverse recesses of the punches when the latter are in their rest position. A resiliently compressible annular body is positioned in the groove of the magazine and protrudes into the transverse recess of each punch when the punch is in its rest position, the compressible body being positioned to be elastically compressed between the magazine and one of the punches when that punch is in its punching position to resiliently bias that punch toward its rest position.

In a most preferred embodiment, the magazine is provided with an outer, circumferential surface having a circumferential groove formed in it, the groove being open to and confronting the transverse recesses of the marking punches. In this embodiment, the marking tool may be simply assembled by inserting the marking punches in their respective channels with their transverse recesses in alignment with the confronting grooves of the magazine, and mounting an annular elastically compressible body such as a polymeric "O" ring within the external transverse groove of the magazine, the compressible annular body extending into the transverse recesses of the marking punches.

In accordance with one method of the invention, a marking tool is readily assembled by installing a plurality of marking punches, each having a transverse recess, into respective circumferentially spaced channels within a punch magazine having a circumferential groove alignable with the transverse recesses. The marking punches are arranged in the magazine to align the transverse recesses of the marking punches with the circumferential groove of the magazine, and an annular resilient, compressible ring is placed in the circumferential groove and extends into each transverse recess to resiliently bias each punch toward its rest position. Preferably, the circumferential groove extends about the exterior of the magazine to facilitate mounting the annular ring therein, the circumferential groove being open to the transverse recesses of the marking punches, the method in this embodiment including the step of fitting the resilient annular ring about the external surface of the magazine until it becomes captured in the circumferential groove.

In use, the magazine is connected to a punch holder so that the magazine is rotatable with respect to a striker. A marking punch with which the workpiece is to be marked is selected. The magazine is rotated with respect to the striker to position the selected marking punch into position to be struck by the striker. The selected marking punch is struck with the striker, causing the selected marking punch to move from its rest position to its punching position to mark the workpiece, thereby resiliently compressing the annular ring between the punch magazine and the selected punch. The striker is then retracted to permit the punch to substantially return to its rest position under the resilient biasing force of the annular ring.

DETAILED DESCRIPTION OF THE PREFERRED EMBODIMENTS

Figure 1:
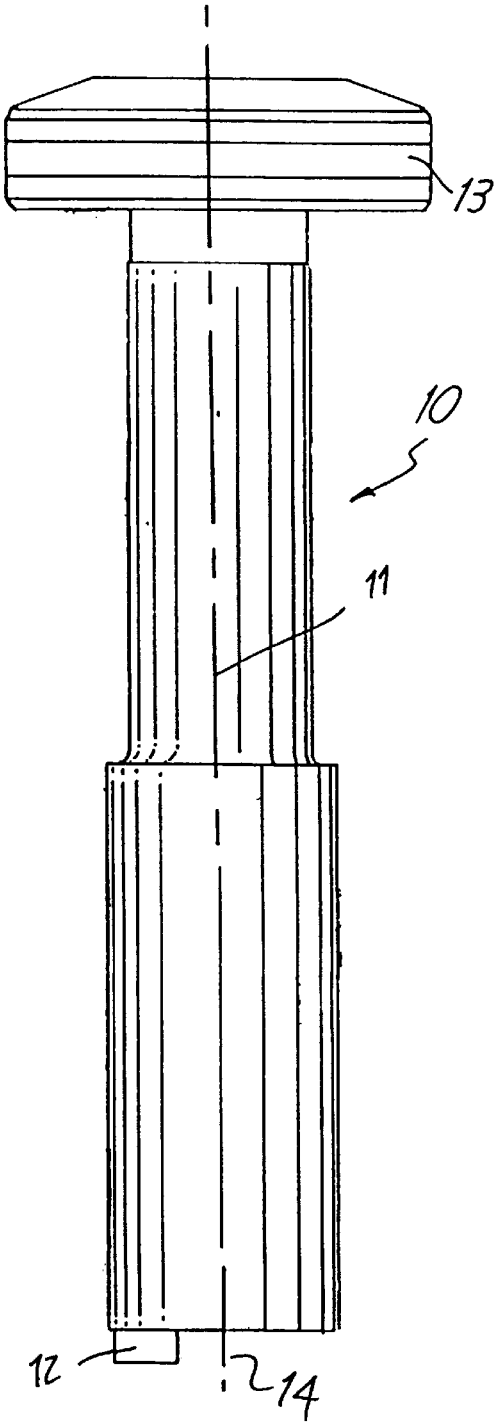
FIG. 1 is a side view side view of a striker in accordance with one embodiment of the invention.

FIG. 1 shows an example of a striker 10. In this particular embodiment, the striker 10 includes a shaft 11, a boss 12, and a base 13. The base 13 is attached to the shaft 11 and is positioned nearest the ram of a punch machine (not shown). The boss 12 is located on the opposite end of the shaft 11 relative to the base 13, and is oriented so as to strike the upper surface of a marking punch such as that depicted as 22 in FIG. 4, the latter being slidably carried in a magazine 20.

The base 13 can be either integrally formed with the shaft 11 or formed as a separate component and attached to the shaft 11. The base 13 is designed to directly receive the ram's striking force during a punch stroke and transfer this force to the shaft 11. Shaft 11 transfers the ram's striking force to the boss 12 during a punch stroke. The shaft 11 also defines the axis of travel 14 for the striker 10 during a punch stroke.

The boss 12 can be either integrally formed with the shaft 11 or formed as a separate component and attached to the shaft 11. The boss 12 is designed to transfer the striking force to a selected punch 22, and protrudes from the end of the shaft 11 sufficiently to limit or prevent the bottom of the shaft 11 from contacting the punches 22 which are not presently selected. Boss 12 is sized such as to preclude the striking of neighboring punches 22 which are not in the selected position.

Figure 2:
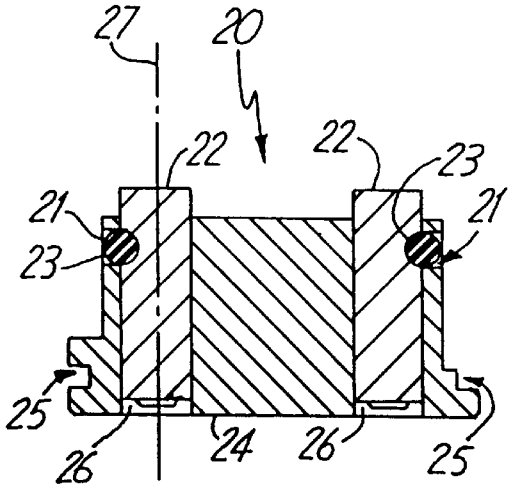
FIG. 2 is a cross-sectional side view of a magazine in accordance with one embodiment of the invention.

FIG. 2 shows one embodiment of a punch magazine 20. The magazine 20 has a generally cylindrical form. If so desired, the base of the magazine may serve as a stripper plate 24. Around the circumference of the magazine 20 is formed a transverse groove 21, the groove as shown desirably being positioned nearer the upper end of the magazine. The magazine 20 has a plurality of circumferentially spaces channels passing therethrough, each channel having an axis 27 substantially parallel to the axis of travel 14 of the striker. The channels slidably house the marking punches 22. The body of each punch marker desirably is generally rectangular in shape when viewed end-on, and the channels desirably have complementary rectangular shapes to appropriately slidingly receive the marking punches.

The circumferential groove 21 extends inwardly from the external surface of the magazine and in the preferred embodiment intersects each of the circumferentially spaced channels 26 so that a compressible annular ring received in the circumferential groove extends inwardly into the respective channels 26. The marking punches each have a transverse recess 43 such that when the marking punches are at their rest positions as shown in FIG. 2, the recesses 43 are aligned with the circumferential groove 21.

The compressible annular ring 23, typically an "O" ring made of rubber or other elastically compressible material, has a diameter sufficient to be firmly and tautly received within the circumferential groove 21. Typically, the ring 23 will be placed in the groove 21 by stretching it over the end of the magazine and guiding it to snap into the groove, the ring thus extending into each recess and being captured within the transverse recesses of the marking punches. The ring must be sufficiently compressible to allow a selected punch 22 to move downwardly into contact with the workpiece during the punch stroke as the ring is compressed between confronting surfaces of the transverse recesses of the marking punch and the circumferential groove. The ring 23 must also be sufficiently resilient to bias the punches 22 toward their resting positions and sufficiently durable to be repeatedly compressed and yet resiliently return the punches to their rest positions.

The magazine may include an exterior retaining ring groove 25 oriented to be aligned with a complementary groove 52 formed interiorly of the punch holder near its bottom end. A removable, springy split retaining ring 53 may be provided which in its rest position extends into the aligned grooves 25, 52 to lock the magazine to the punch holder. Further, the holder and magazine may have a pin and pin-receiving hole, respectively, which engage to rotationally lock the magazine to the holder.

Figure 3:
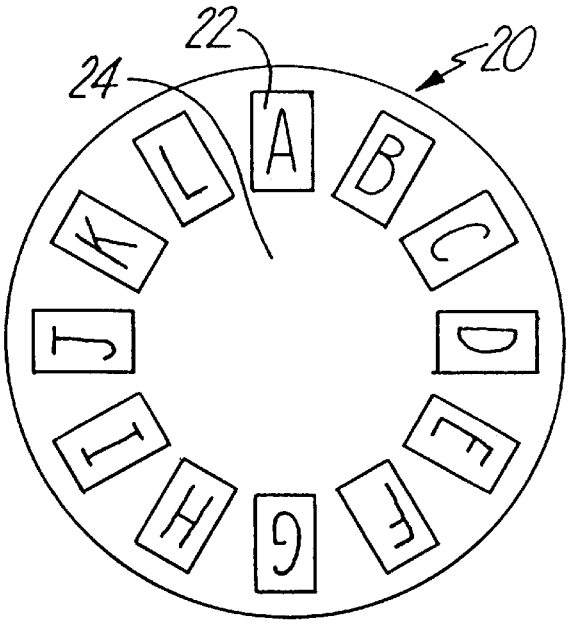
FIG. 3 is a bottom view of the magazine of FIG. 2.

FIG. 3 shows a face of the magazine 20. A series of channels 26, each housing a punch 22, can been seen. In this particular embodiment, twelve channels 26 are spaced substantially equiangularly from one another along a circle centered on the center of the magazine. The number of channels in any given embodiment of the magazine 20 may vary, and may be a function of the number of different punches 22 one seeks to make available, as well as the sizes of the magazine 20 and punches 22. The channels 26 are spaced circumferentially about the magazine to facilitate punch 22 selection via rotation of the magazine about an axis 14. The remaining surface of this side of the magazine 20 may serve as a stripper plate 24.

Figure 4:
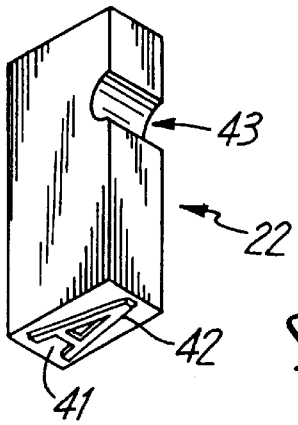
FIG. 4 is a bottom perspective view of a marking punch in accordance with one embodiment of the invention.

FIG. 4 illustrates one punch 22 in accordance with the invention. This punch 22 may be a marking punch having a marking face 41 which has a raised mark 42 which serves to create alpha-numeric characters or other indicia upon the workpiece. This raised mark 42 can be a variety of characters or strings of characters.

As noted above, a plurality of such marking punches 22 having a variety of raised marks 42 can be housed in a magazine 20. This allows selection of a series of different indicia by rotating the magazine 20 to place the selected punch 22 in position beneath the boss 12 to be struck by the boss. Each punch 22 is received in a channel of the magazine 20 such that at least the marking face 41 is received in the channel when the punch is in its resting position, i.e., the position which it occupies under the biasing force of the annular ring 23 when there are no other external forces applied to the punch and in which the transverse recesses 43 of the marking punches are substantially aligned with the circumferential groove 21 of the magazine. When the punch is struck by the striker 10, at least the marking face 41 will extend out of the channel to extend beyond the magazine 20 so it may strike the workpiece (not shown).

The transverse recess 43 formed in each of the marking punches is sized to receive a length of the compressible annular ring 23 when housed in the magazine 20. This recess 43 is positioned so that it is in communication with the magazine's transverse groove 21 when the punch 22 is in its resting position. Ideally, when the punch is in its resting position, the recess 43 in the punch is generally aligned with the transverse groove 21 of the magazine, but this alignment need not be precise and will likely vary over time as the annular ring is subjected to repeated usage cycles.

Placing the recesses 43 of the punches in communication with the transverse groove 21 in the magazine permits the ring 23 to seat both in the groove 21 of the magazine 20 and the recess 43 in each punch 22 when the ring 23 is positioned in the transverse groove 21. As a result, one ring 23 will retain all of the punches 22 in the magazine 20 and simultaneously bias all of the punches 22 toward their rest positions within their respective channels 26.

Downward motion of the annular ring 23 is limited by the transverse groove 21 in the magazine 20. When a punch is struck by the striker 10, the punch will move downwardly in the channel 26, stretching and compressing a short length of the ring 23. When the striker 10 moves up away from the punch 22 again, the resilient ring 23 will pull the punch 22 back up toward the punch's rest position.

Figure 5:
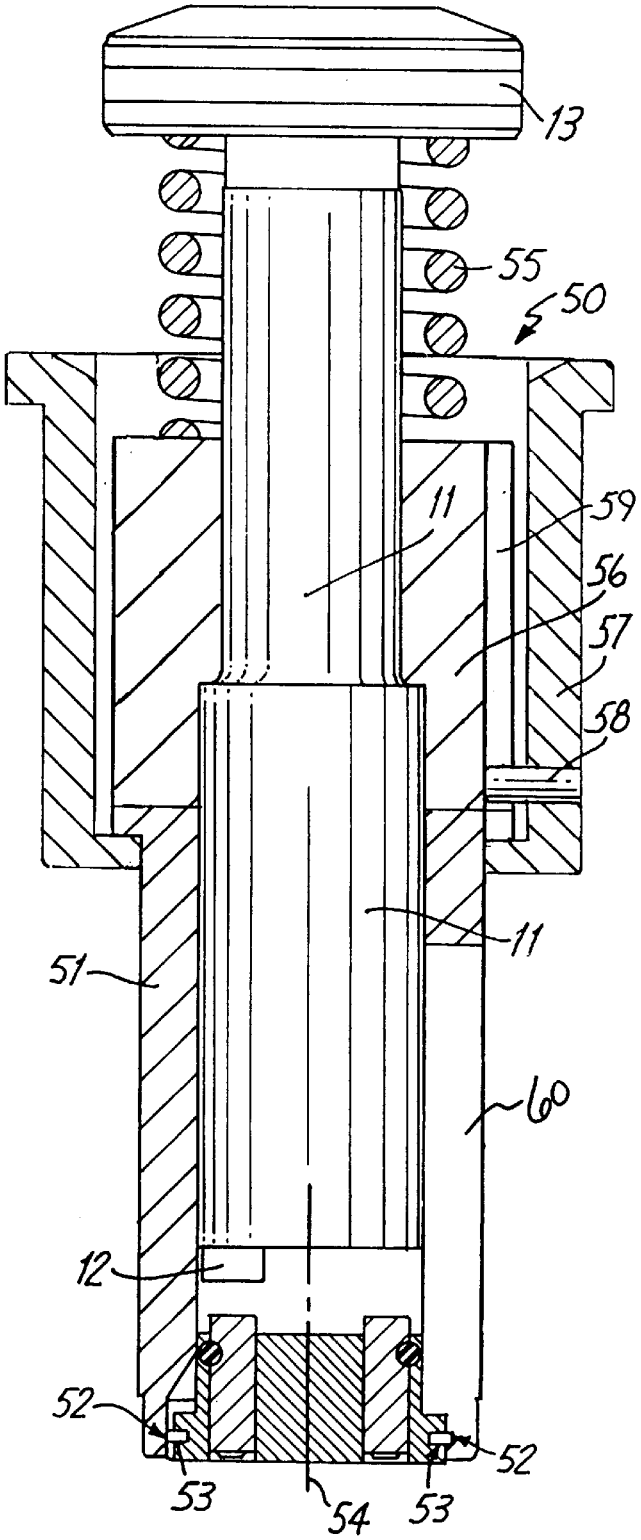
FIG. 5 is a cross-sectional side view of an assembled punch assembly in accordance with one embodiment of the invention.

FIG. 5 shows a punch assembly 50 which consists of the striker shaft 11, the magazine, a plurality of punches, the punch holder 51 having an internal retaining ring groove 52 and an axially extending slot 60, a retaining ring 53, a spring 55 for biasing the striker away from the punches 22, a punch collar 56 having an external, axially extending groove 59, and a punch sleeve 57 carrying an inwardly protruding pin 58 received in the slot 59 of the collar. This entire assembly can be attached to a standard punch press so that the ram of the punch press can strike the base 13 of the striker, causing the boss 12 to strike punch 22 which, in turn, contacts a workpiece (not shown) for marking.

The magazine 20 is non-rotatably received in the punch holder 51. More particularly, the magazine 20 together with the punch holder 51 is permitted to rotate about the axis of the punch holder 51 to change the rotational orientation of the magazine 20 with respect to the striker 10. The striker is non-rotatably but axially slidably coupled (by means of a pin and slot arrangement similar to the pin 58 and slot 59 arrangement shown in FIG. 5) to the collar. The collar, in turn, is non-rotatably coupled as explained above to the punch sleeve by interaction of the pin 58 and slot 59. The resulting punch assembly 50 is received within the turret of a punch press. In this manner, by rotating the punch holder and attached magazine, one can select which of the plurality of punches 22 received in the magazine 20 will be struck by the striker 10 when the ram strikes the striker 10.

The punch holder 51 seen in this embodiment has a generally cylindrical shape with an internal passage for the housing of the striker 10 and the magazine 20. This internal passage has an axis 54 substantially parallel to the axis of travel 14 of the striker. The magazine 20 can be attached to the punch holder 51 in any suitable fashion. As mentioned above, one such connection that allows the magazine to turn with respect to the striker 10 employs a split retaining ring 53 of spring steel or the like which is received in a retaining ring groove 25 in the magazine and in a retaining ring groove 52 in the punch holder. By closing the gap somewhat between split ends of the ring, one can reduce the diameter of the ring 53 sufficiently to permit it to be moved out of the magazine retaining ring groove 52. This permits the magazine 20 to be removed from the punch holder 51. One embodiment of punch holder 51 has a slot 60 used to connect the holder 51 to a means for selectively circumferentially indexing the holder 51 and magazine 20 with respect to the striker.

As noted above, the present invention also contemplates a method of assembling a marking punch tool of the type described above. This method is particularly well suited for use in connection with the punch assembly 50 shown in the drawings and the following discussion refers to components of the illustrated assembly by reference number.

In this method, a plurality of marking punches 22 are provided, each of the marking punches 22 having a transverse recess 43 therein. Each marking punch 22 is placed into a different one of a plurality of channels 26 within the punch magazine 20, the magazine having an externally accessible circumferential groove that intersects each of the channels. A resiliently compressible annular ring 23 is placed tautly in the circumferential groove 21 in the punch magazine 20 and extends into the recess 43 of each of the punches 22. In this manner, a single annular ring 23 can resiliently bias each of the marking punches toward its rest position. If, during the assembly, a marking punch becomes misaligned within its channel, the misaligned punch 22 can be moved within its channel with the ring 23 in place until the ring 23 snaps into the recess 43 in the punch 22. If desired, a damaged or unwanted marking punch can be replaced with another punch simply by withdrawing the annular ring from the circumferential groove slightly in the vicinity of the unwanted punch, pushing the unwanted punch axially out of the magazine, inserting a new punch, and permitting the annular ring to snap back into position.

The magazine 20 with the punches 22 retained therein can then be attached to a punch holder 51. As explained above, the magazine 20 is desirably rotatable with respect to the striker 10. One of the marking punches 22 will be selected to mark the workpiece and the magazine 20 can be rotated with respect to the striker 10 to position the selected marking punch 22 into position to be struck by said striker. Typically, the boss 12 of the striker will be oriented directly above the selected punch 22.

The selected marking punch 22 can then be struck with the striker 10, causing the punch 22 to move from its rest position to its punching position to mark the workpiece. As previously described, when the punch 22 is moved toward its punching position, it will resiliently compress the annular ring 23 between the punch magazine 20 and the punch 22 because a length of the ring 23 is retained within the recess 43 of the punch 22. The striker 10 can then be retracted to permit the marking punch 22 to substantially return to its rest position under the resilient biasing force of the annular ring 23.

This method will mark the workpiece with the character 42 on the punching face 41. To allow more flexibility in marking the workpiece, the plurality of punches 22 may each have a different character thereon. Once the workpiece is marked with the first punch 22 as outlined above and the striker 10 and punch 22 have retracted sufficiently, a second one of the marking punches 22 having a different character thereon will be selected. The workpiece can then be marked with the second punch 22 in the same manner described above.

While a preferred embodiment of the present invention has been described, it should be understood that various changes, adaptations and modifications may be made therein without departing from the spirit of the invention and the scope of the appended claims.

What is claimed is:

1. A tool for use with a punch press, comprising:

a plurality of punches;

a punch magazine having a plurality of channels, each of which is sized to slidably receive one of said punches and to enable the punch to move therein between rest and punching positions, and said magazine having an external circumferential surface wherein a transverse groove is formed in said circumferential surface;

a striker for selectively striking a selected one of the punches to move the selected punch from its rest position to its punching position during a punching operation; and a resiliently compressible body received in said groove between said magazine and each of said punches, the body being compressed between the magazine and one of the punches when said punch is in its punching position but resiliently biasing each of the punches toward its rest position.

2. A tool for use with a punch press, comprising:

a plurality of punches;

a punch holder including a punch magazine having a plurality of channels circumferentially spaced about an axis and within which the marking punches are respectively received for movement between marking and rest positions, the magazine having an external circumferential surface with an annular recess formed therein and the marking punches each having a recess confronting said annular recess, a striker for selectively striking a selected one of the punches to move the selected punch from its rest position to its punching position during a punching operation, said magazine being rotatable with respect to said punch striker to enable the punch striker to strike an individual one of the marking punches; and an elastically deformable annular body received in the annular recess and in the punch recesses, and positioned to be elastically deformed therebetween when a marking punch is moved to its marking position and to bias the marking punch toward its rest position.

3. A method of assembling a marking tool, comprising:

a) providing a plurality of marking punches, each of which has a transverse recess;

b) positioning each of said punches into a different one of a plurality of channels within a punch magazine that has a transverse groove formed in an exterior surface of the magazine, intersecting said channels;

c) aligning each said marking punch recess with said transverse groove; and d) mounting an annular compressible body within said transverse groove by tautly placing said annular compressible body on said exterior surface while maintaining said transverse groove and punch recesses in substantial alignment, and permitting said annular body to snap into said groove, the annular body thus being captured by both said transverse groove and said punch recesses.

4. A tool for use with a punch press, comprising:

a plurality of punches each having a recess;

a punch magazine having a plurality of channels, each of which is sized to slidably receive one of said punches and to enable the punch to move therein between rest and punching positions, said magazine having an external circumferential surface having formed therein a transverse groove communicating with each of said channels, a resiliently compressible body comprising an annular ring received in said transverse groove and in the recess of each of said punches between said magazine and each of said punches, the body being compressed between the magazine and one of the punches when said punch is in its punching position but resiliently biasing each of the punches toward its rest position; and a striker for selectively striking a selected one of the punches to move the selected punch from its rest position to its punching position during a punching operation.

5. The tool of claim 4 further comprising a punch holder carrying said magazine and being rotatable with respect to said striker to position the selected punch into position to be struck by the striker.

6. The tool of claim 4 wherein each of said punches have a punching face which is recessed within one of said magazine channels when said punch is at its rest position, but which extends outside said magazine channel when said punch is at its punching position.

* * * * *